US005753360A

United States Patent [19]

Jones et al.

[11] Patent Number: 5,753,360

[45] Date of Patent: May 19, 1998

[54] MEDIUM FOR PHASE CHANGE INK PRINTING

[75] Inventors: Richard Roy Jones, Hendersonville; Troy Lee Maybin, Zirconia; Jule Williasm Thomas, Jr.; Jose Esteban Valentini, both of Hendersonville, all of N.C.

[73] Assignee: Sterling Diagnostic Imaging, Inc., Newark, Del.

[21] Appl. No.: 679,543

[22] Filed: Jul. 12, 1996

[51] Int. Cl.[6] ..... B41M 5/00

[52] U.S. Cl. ..... 428/323; 428/195; 428/331; 428/341; 428/480; 428/520

[58] Field of Search ..... 428/480, 331, 428/500, 478.2, 520, 195, 328–330, 341, 323

[56] References Cited

U.S. PATENT DOCUMENTS

| | | | |
|---|---|---|---|
| 4,460,637 | 7/1984 | Miyamoto et al. | 428/331 |
| 4,542,059 | 9/1985 | Toganoh et al. . | |
| 4,636,410 | 1/1987 | Akiya et al. . | |
| 5,276,468 | 1/1994 | Deur et al. . | |

FOREIGN PATENT DOCUMENTS

| | | |
|---|---|---|
| 0435675 | 7/1991 | European Pat. Off. . |
| 0487349 | 5/1992 | European Pat. Off. . |
| 0582466 | 2/1994 | European Pat. Off. . |
| 0634287 | 1/1995 | European Pat. Off. . |
| 632046 | 2/1974 | Japan . |
| 62-160287 | 7/1987 | Japan . |
| 4364947 | 12/1992 | Japan . |
| 551470 | 3/1993 | Japan . |
| 693122 | 4/1994 | Japan . |
| 781214 | 3/1995 | Japan . |
| 2147003 | 5/1985 | United Kingdom . |

*Primary Examiner*—Pamela R. Schwartz
*Attorney, Agent, or Firm*—Joseph T. Guy, Jr.

[57] ABSTRACT

A recording media for phase change ink recording comprising: a support; 1–30 mg/dm$^2$ of a receptive layer coated on the support wherein the receptive layer comprises: a binder comprising: a water soluble polymer; and a water insoluble polymer; wherein the combined weight of the water soluble polymer and the water insoluble polymer comprises at least 15%, by weight, and no more than 90%, by weight, water insoluble binder; and an inorganic particulate material with a hydrodynamic diameter in water of no more than 0.3 μm wherein the inorganic particulate material represents at least 50%, by weight, and no more than 95%, by weight, of the combined coating weight of the water soluble polymer, the water insoluble polymer and the inorganic particulate material.

20 Claims, No Drawings

MEDIUM FOR PHASE CHANGE INK PRINTING

FIELD OF INVENTION

The present invention is directed to an improved transparent media for use with ink jet printers. More specifically, the present invention is directed to an improved media which is superior as a receptor for phase change ink printing.

BACKGROUND OF THE INVENTION

Transparent films displaying information are widely used throughout many different industries and for many applications. Typically, a positive image is formed by placing an ink or pigment onto a transparent plastic sheet. The image is then displayed by projection of transmitted light.

Phase change ink printing has been demonstrated to be a superior method of printing. Among the advantages offered by phase change ink printing is the ability to obtain a high optical density and large print areas without the necessity for removing large volumes of solvent. The impact of phase change ink printing for transparencies has been impeded due to the lack of a suitable transparent media. Transparent media designed for use with aqueous ink jet printers are often used but these exhibit insufficient adhesion between the phase change ink and the media.

Phase change inks are characterized by their ability to remain in a solid state at ambient to warm conditions yet melt to a liquid at the printing head operating temperatures. Exemplary printing apparatus are disclosed, for example, in U.S. Pat. No. 5,276,468. The physical thermomechanical properties of the solid glassy state, the solid rubbery plateau state and the liquid melt are all important in the design of the phase change inks and printers. Exemplary phase change inks are provided, for example, in U.S. Pat. No. 5,372,852.

Contrary to solvent ink systems the phase change ink resides on the surface of the media and does not appreciably diffuse into the matrix of the media or coating. This phenomenon has challenged skilled artisans to develop a media which has suitable adhesion with the phase change inks. Increasing surface area is a known method for increasing adhesive properties of an opaque media. Increasing surface area alone is unsuitable for transparent media since the higher surface area can cause excessive visible light scatter. In opaque media light scatter can be pleasing and is often referred to in the art as a mat finish. In transparent media visible light scattering must be sufficiently low to insure that the media will not appear hazy which is objectionable.

Susceptibility to artifacts is likewise a problem for the design of phase change ink printing media. The phase change ink is on the surface of the media and therefore susceptible to being removed by abrasion. Prior to the present invention the art lacked a media which could provide adequate adhesion, low haze, and suitable resistance to scratching.

The visual appearance of scratch artifacts is the manifestation of three separate phenomenon. One phenomenon is a scratch on the media itself which is the result of physical removal of the surface receptor coating. Physical scratches in the receptor coating are quantified by a scratch test using a pointed object of known dimension and force of application. A second phenomenon appearing as a scratch is the physical removal of the phase change ink from the surface of the media. This type of visual scratch is quantified by a measure of the adhesion between the ink and the surface of the media. The present invention improves the scratch resistance of both sources, those associated solely with the receptive layer coated on the media, and those associated with adhesion of the phase change ink to the receptive layer.

A third form of visual scratch occurs when part of the phase change ink only is removed. This particular type of visual scratch is solely a function of the rheology of the phase change ink and is not addressed in the present invention.

There is a need for a media which will take full advantage of the properties offered by phase change ink printing. Provided herein is a coated media which exhibits excellent adhesion to phase change ink, offers high clarity, and improves durability of the printed image as measured by increased resistance to surface scratching.

SUMMARY OF THE INVENTION

It is an object of the present invention to provide an improved recording media. A particular object is to provide a media which is suitable for use with phase change ink printing.

A particular feature of the present invention is improved scratch resistance during physical abrasion of the media.

Another particular feature is the increased adhesion between the phase change ink and the media.

These improvements are achieved while retaining high clarity of the media such that maximum contrast of printed and unprinted areas is possible.

These and other advantages are provided in a recording media for phase change ink recording comprising: a support; 1–30 mg/dm$^2$ of a receptive layer coated on said support wherein said receptive layer comprises: a binder comprising: a water soluble polymer; and a water insoluble polymer; wherein the combined weight of said water soluble polymer and said water insoluble polymer comprises at least 15%, by weight, and no more than 90%, by weight, water insoluble binder; and an inorganic particulate material with a hydrodynamic diameter in water of no more than 0.3 μm wherein said inorganic particulate material represents at least 50%, by weight, and no more than 95%, by weight, of the combined coating weight of said water soluble polymer, said water insoluble polymer and said inorganic particulate material.

DETAILED DESCRIPTION OF THE INVENTION

The inventive media comprises a support with a receptive layer coated thereon.

The receptive layer comprises a binder with an inorganic particulate material dispersed therein. The binder comprises a water soluble polymer and a water insoluble polymer.

The term "water soluble polymer" refers specifically to polymers which dissolve in water completely as characterized by the hydrodynamic particle diameter in water as measured by light scattering. For purposes of the present invention, a polymer with a light scattering hydrodynamic particle diameter, in water, of no more than 0.05 μm indicates molecular scale dissolution. A polymer with a light scattering hydrodynamic particle diameter, in water, of no more than 0.05 μm is referred to herein as a water soluble polymer. The water soluble polymer preferably comprises at least one compound chosen from a group consisting of polyvinyl alcohol, polyacrylamide, methyl cellulose, polyvinyl pyrrolidone and gelatin. The water soluble polymer more preferably comprises polymerized monomer chosen from a group consisting of vinyl alcohol, acrylamide and vinyl pyrrolidone. While not restricted to any theory it is hypothesized that the main role of the water soluble polymer is to anchor the silica to the support. Based on this hypothesis an increased level of water soluble polymer is preferred for scratch resistance.

The term "water insoluble polymer" refers specifically to polymers which form a dispersion in water characterized by the hydrodynamic particle diameter, in water, as determined by light scattering. A light scattering hydrodynamic particle diameter, in water, of greater than 0.05 μm implies a dispersion of aggregates containing more than one molecule requiring solubilization by surfactants. Polymer particles with a light scattering hydrodynamic particle diameter, in water, of greater than 0.05 μm are referred to herein as water insoluble polymers. The water soluble polymer preferably comprises at least one polymerized monomer chosen from acrylic, olefin, vinyl, urethane and amide. The water insoluble polymer most preferably comprises at least one compound chosen from acrylic, urethane, polyolefin and vinyl latexes. The water insoluble polymers may comprise polar functionality with the proviso that the degree of functionality is below a level sufficient to form a water soluble polymer. While not restricted to any theory the water insoluble polymer is hypothesized to enhance adhesion at low coating weights. Based on this hypothesis increased levels of water insoluble polymer are expected to increase adhesion between the phase change ink and the receptive layer and between the receptive layer and the support.

The ratio of water soluble polymer to water insoluble polymer is chosen to maximize the unexpected synergistic properties and to take advantage of the ability of the phase change ink to adhere to the media while still maintaining adequate scratch protection. It is preferred that the combined weight of water soluble binder and water insoluble binder comprise at least 15%, by weight, water insoluble polymer. Below 15% water insoluble polymer scratch resistance unexpectedly deteriorates to levels which are unacceptable in a commercially viable product. It is more preferable that the combined weight of the water soluble and water insoluble polymer comprise at least 20%, by weight, water insoluble polymer and most preferably at least 40% by weight water insoluble polymer. It is preferred that the combined weight of the water soluble polymer and water insoluble polymer comprise no more than 90%, by weight, water insoluble polymer due to a decrease in scratch resistance which occurs above 90%, by weight, water insoluble polymer.

The inorganic particulate material is preferably chosen from a group consisting of colloidal silica and alumina. The preferred inorganic particulate material is silica with a hydrodynamic diameter in water of no more than 0.3 μm. Above a hydrodynamic diameter in water of 0.3 μm the haze of the coated layer becomes objectionable. While not restricted to any theory the increase in haze is hypothesized to be due to the increase in light scattering from the larger particles. More preferably the inorganic particulate material has a hydrodynamic diameter in water of no more than 0.1 μm. Also preferred as a particulate material is silica with a hydrodynamic diameter in water of no more than about 0.05 μm. The silica is preferably at least 0.005 μm. A hydrodynamic diameter in water between 0.005 μm and 0.030 μm with a specific surface area between 100 and 300 $m^2/g$ is particularly advantageous for superior adhesion. More preferred for adhesion is a silica hydrodynamic diameter in water of 0.010 to 0.020 μm with a surface area of 200 to 300 $m^2/g$. Scratch resistance is most improved with a silica hydrodynamic diameter in water of 0.01 to 0.015 μm and a specific surface area of 200 to 250 $m^2/g$.

A preferred colloidal silica for use in this invention is a multispherically coupled and/or branched colloidal silica. Specific examples are colloidal silica particles having a long chain structure in which spherical colloidal silica is coupled in a multispherical form. Also preferred is a colloidal silica in which the coupled silica is branched. Multispherically coupled colloidal silica is obtained by forming particle-particle bonds between primary particles of spherical silica by interspersing metal ions having a valence of two or more between the spherical silica particles. Preferably, the multispherically coupled colloidal silica has at least three particles coupled together. More preferably the multispherically coupled colloidal silica has at least five particles coupled together and most preferably the multispherically coupled colloidal silica has at least seven particles coupled together.

The degree of ionization of silica plays an important role in the ionic strength of the coating solution. The ionic strength of the coating solution has been determined to play a major role in the haze of the final media. The ionic strength of the coating formulation is determined from the ionic conductivity of the coating solution prior to application on the support. Preferred is a total coating solution ionic conductivity of no more than 0.7 mS (Siemens$\times 10^3$) as measured at 25° C. with 10%, by weight, total solids, using a properly standardized EC Meter Model 19101-00 available from Cole-Parmer Instrument Company of Chicago Ill., USA. More preferred is an ionic conductivity of no more than 0.5 mS, when measured at 25° C. and 10%, by weight, total solids. Most preferred is an ionic conductivity of no more than 0.3 mS, when measured at 25° C. and 10%, by weight, total solids.

The hydrodynamic diameter in water of the inorganic particulate material is determined as the diameter of a spherical particle with the same hydrodynamic properties as the sample in question. By way of example, a fibrous silica particle with dimensions of approximately 0.150 μm by 0.014 μm exhibits a hydrodynamic diameter in water of approximately 0.035 μm.

The receptor layer is applied to the support as a coating suspension in a solvent. The most preferred solvent is water. The coating suspension comprises inorganic particulate material, a water soluble polymer and a water insoluble polymer. After application of the coating suspension onto the support the solvent is removed yielding a solid receptive layer comprising inorganic particulate matter, water soluble polymer and water insoluble polymer. Other ingredients may be included in the receptive layer as further detailed below. For the purpose of demonstrating the present invention a coating weight was determined by integration of the infrared absorption peak at 470 $cm^{-1}$ obtained by subtraction of the support spectrum. The integrated 470 $cm^{-1}$ infrared absorption peak was calibrated with a strontium X-ray photoelectron standards produced by the addition of strontium nitrate to the formulation. Unless otherwise specified, coating weight is reported as the total milligrams of receptive layer coated in an area of 1 square decimeter ($mgm/dm^2$). Coating weight can also be reported as coated thickness assuming a density of approximately 2.0 $gm/cm^3$.

The combined coating weight of the inorganic particulate matter, the water soluble polymer, and the water insoluble polymer is preferably at least 1 $mg/dm^2$. Below a combined coating weight of 1 $mg/dm^2$ adhesion between the phase change ink and the receptor level degrades to levels which are unsuitable for practical consideration. Furthermore, coating efficiency degrades below 1 $mg/dm^2$ which negatively impacts the cost of manufacturing the media. It is more preferred that the combined coating weight of the inorganic particulate material, the water soluble polymer and the water insoluble polymer be at least 3 mg/dm$^2$. Most preferred is a combined coating weight of the inorganic particulate material, the water soluble polymer and the water insoluble polymer of at least 5 mg/dm$^2$ to insure adequate phase change ink adhesion and adequate resistance to scratching. It is most preferable that the combined weight of the inorganic particulate material, the water soluble polymer and the water insoluble polymer be sufficient to provide a coated thickness which is no less than the size of the aggregated inorganic particulate material. As the combined coating weight of the inorganic particulate material, the water soluble polymer and the water insoluble polymer increases the haze increases. It is most preferable to achieve a high clarity as represented by a total haze of less than 8%. Suitable total haze is achieved with a combined coating weight of the inorganic particulate material, the water soluble polymer and the water insoluble polymer of no more than 30 mg/dm$^2$. A combined coating weight of the inorganic particulate material, the water soluble polymer and the water insoluble polymer of less than 20 mg/dm$^2$ is more preferred and most preferred is a combined coating weight of the inorganic particulate material, the water soluble polymer and the water insoluble polymer of no more than 15 mg/dm$^2$.

The inorganic particulate matter of the receptive layer represents at least 50%, by weight, and no more than 95%, by weight, of the combined coating weight of the inorganic particulate matter, the water soluble polymer and the water insoluble polymer. Above 95%, by weight, inorganic particulate matter the scratch resistance becomes unacceptable. Below 50%, by weight, inorganic particulate matter the adhesion of the ink to the media decreases to unacceptably low levels as determined by a tape test. Preferably the inorganic particulate matter represents at least 70% and no more than 90% of the total weight of the receptive layer. Most preferably the inorganic particulate matter represents 75–90% of the total weight of the receptive layer to achieve the best balance between scratch resistance and adhesion.

It is most preferable to add a cross linker to the receptive layer to increase the strength of the dried coating. Preferred cross linkers are capable of forming siloxane bonds. Aldehyde hardeners such as formaldehyde or glutaraldehyde are suitable hardeners. Pyridinium based hardeners such as those described in, for example, U.S. Pat. Nos. 3,880,665, 4,418,142, 4,063,952 and 4,014,862 and imidazolium hardeners as defined in Fodor, et al, U.S. Pat. No. 5,459,029; U.S. Pat. No. 5,378,842; U.S. Pat. No. 5,591,863; and U.S. Pat. No. 5,601,971 are suitable for use in the present invention. Particularly suitable hardeners are defined by the formula, $R^1_nSi(OR^2)_{4-n}$ where $R^1$ is an alkyl, or substituted alkyl, of 1 to 18 carbons; $R^2$ is hydrogen, or an alkyl, or substituted alkyl, of 1 to 18 carbons; and n is an integer of 1 or 2. Aziridenes and epoxides are also suitable hardeners.

Crosslinking is well known in the art to form intermolecular bonds between various molecules thereby forming a network. In the instant invention a crosslinker may be chosen to form intermolecular bonds between pairs of water soluble polymers, between pairs of water insoluble polymers, or between water soluble polymers and water insoluble polymers. If crosslinking is applied it is most preferable to crosslink the polymers to the inorganic particulate matter. It is preferable to apply any crosslinking additive just prior to or during coating. It is contemplated that the crosslinking may occur prior to formation of the coating solution or in situ.

The term "gelatin" as used herein refers to the protein substances which are derived from collagen. In the context of the present invention "gelatin" also refers to substantially equivalent substances such as synthetic analogues of gelatin. Generally gelatin is classified as alkaline gelatin, acidic gelatin or enzymatic gelatin. Alkaline gelatin is obtained from the treatment of collagen with a base such as calcium hydroxide, for example. Acidic gelatin is that which is obtained from the treatment of collagen in acid such as, for example, hydrochloric acid and enzymatic gelatin is generated with a hydrolase treatment of collagen. The teachings of the present invention are not restricted to gelatin type or the molecular weight of the gelatin with the proviso that after preparation of the gelatin a sufficient number of pendant carboxylic acid and amine groups remain for reactivity as taught herein. Carboxyl-containing and amine containing polymers, or copolymers, can be modified as taught herein so as to lessen water absorption without degrading the desirable properties associated with such polymers and copolymers.

Other materials can be added to the receptive layer to aid in coating and to alter the Theological properties of either the coating solution or the dried layer. Polymethylmethacrylate beads can be added to assist with transport through phase change ink printers. Care must be taken to insure that the amount of beads is maintained at a low enough level to insure that adhesion of the phase change ink to the substrate is not deteriorated. Preferably, the beads should represent no more than about 1.0% by weight of the receptive layer. It is conventional to add surfactants to a coating solution to improve the coating quality. Surfactants and conventional coating aids are compatible with the present invention.

The preferred support is a polyester obtained from the condensation polymerization of a diol and a dicarboxylic acid. Preferred dicarboxylic acids include terephthalate acid, isophthalic acid, phthalic acid, naphthalenedicarboxylic acid, adipic acid and sebacic acid. Preferred diols include ethylene glycol, trimethylene glycol, tetramethylene glycol and cyclohexanedimethanol. Specific polyesters suitable for use in the present invention are polyethylene terephthalate, polyethylene-p-hydroxybenzoate, poly-1,4-cyclohexylene dimethylene terephthalate, and polyethylene-2,6-naphthalenecarboxylate. Polyethylene terephthalate is the most preferred polyester for the support due to superior water resistance, excellent chemical resistance and durability. The polyester support is preferably 1–10 mil in thickness. More preferably the polyester support is 3–8 mil thick and most preferably the polyester support is either 3.5–4.5 mil or 6–8 mil thick. The receptive layer may also be applied to cellulose base media such as paper and the like.

A primer layer is preferably included between the receptive layer and the support to provide increased adhesion between the receptive layer and the support. Preferred primer layers are resin layers or antistatic layers. Resin and antistatic primer layers are described, for example, in U.S. Pat. Nos. 3,567,452; 4,916,011; 4,701,403; 4,891,308; and 4,225,665, and in U.S. Pat. No. 5,554,447 which is commonly assigned with the present application.

The primer layer is typically applied and dry-cured during the manufacture of the polyester support. When polyethylene terephthalate is manufactured for use as a photographic support, the polymer is cast as a film, the mixed polymer primer layer composition is applied to one or both sides and the structure is then biaxially stretched. The biaxial stretching is optionally followed by coating of either a gelatin subbing layer or an antistatic layer. Upon completion of the stretching and the application of the primer layer compositions, it is necessary to remove strain and tension in the support by a heat treatment comparable to the annealing of glass. Air temperatures of from 100° C. to 160° C. are typically used for this heat treatment.

It is preferable to activate the surface of the support prior to coating to improve the coating quality thereon. The activation can be accomplished by corona-discharge, glow-discharge, UV-rays or flame treatment. Corona-discharge is preferred and can be carried out to apply an energy of 1 mw to 1 $kW/m^2$. More preferred is an energy of 0.1 w to 5 $w/m^2$.

Bactericides may optionally be added to the receptive layer or the primer layer to prevent bacteria growth. Preferred are Kathon®, neomycin sulfate, and others as known in the art.

An optional, but preferred backing layer can be added opposite the receptive layer to decrease curl, impart color, assist in transport, and other properties as common to the art. The backing layer may comprise cross linkers to assist in the formation of a stronger matrix. Preferred cross linkers for the backing layer are carboxyl activating agents as defined in Weatherill, U.S. Pat. No. 5,391,477. Most preferred are imidazolium hardeners as defined in Fodor, et al, U.S. Pat. No. 5,459,029; U.S. Pat. No. 5,591,863; and U.S. Pat. No. 5,601,971. Aziridine and epoxy crosslinkers are also suitable crosslinkers. The backing layer may also comprise transport beads such as polymethylmethacrylate. It is known in the art to add various surfactants to improve coating quality. Such teachings are relevant to the backing layer of the present invention.

Phase change inks are characterized, in part, by their propensity to remain in a solid phase at ambient temperature and in the liquid phase at elevated temperatures in the printing head. The ink is heated to the liquid phase and droplets of liquid ink are ejected from the printing head. When the ink droplets contact the surface of the printing media they quickly solidify to form a pattern of solid ink drops. This process is known as direct ink jet printing. Other devices deliver the liquid ink droplets to a heated drum, maintained just below the melting temperature of the phase change inks. The patterned ink is then transferred from the drum in the rubbery state to the media under pressure. This process is known as indirect printing.

The phase change ink composition comprises the combination of a phase change ink carrier and a compatible colorant. The thermomechanical properties of the carrier are adjusted according to the mode of printing and further to match the precise parameters of the printer design. Thus each printer design has a matching optimized ink.

Exemplary phase change ink colorants comprise a phase change ink soluble complex of (a) a tertiary alkyl primary amine and (b) dye chromophores having at least one pendant acid functional group in the free acid form. Each of the dye chromophores employed in producing the phase change ink colorants are characterized as follows: (1) the unmodified counterpart dye chromophores employed in the formation of the chemical modified dye chromophores have limited solubility in the phase change ink carrier compositions, (2) the chemically modified dye chromophores have at least one free acid group, and (3) the chemically modified dye chromophores form phase change ink soluble complexes with tertiary alkyl primary amines. For example, the modified phase change ink colorants can be produced from unmodified dye chromophores such as the class of Color Index dyes referred to as Acid and Direct dyes. These unmodified dye chromophores have limited solubility in the phase change ink carrier so that insufficient color is produced from inks made from these carriers. The modified dye chromophore preferably comprises a free acid derivative of an xanthene dye.

The tertiary alkyl primary amine typically includes alkyl groups having a total of 12 to 22 carbon atoms, and preferably from 12 to 14 carbon atoms. The tertiary alkyl primary amines of particular interest are produced by Rohm and Haas, Incorporated of Houston, Texas under the trade names Primene JMT and Primene 81-R. Primene 81-R is the preferred material. The tertiary alkyl primary amine of this invention comprises a composition represented by the structural formula:

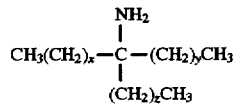

wherein:

x is an integer of from 0 to 18;

y is an integer of from 0 to 18; and z is an integer of from 0 to 18;

with the proviso that the integers x, y and z are chosen according to the relationship:

$x+y+z=8$ to 18.

Exemplary phase change ink carriers typically comprise a fatty amide containing material. The fatty amide-containing material of the phase change ink carrier composition preferably comprises a tetraamide compound. The preferred tetra-amide compounds for producing the phase change ink carrier composition are dimeric acid-based tetra-amides which preferably include the reaction product of a fatty acid, a diamine such as ethylene diamine and a dimer acid. Fatty acids having from 10 to 22 carbon atoms are preferably employed in the formation of the dimer acid-based tetra-amide. These dimer acid-based tetramides are produced by Union Camp and comprise the reaction product of ethylene diamine, dimer acid, and a fatty acid chosen from decanoic acid, myristic acid, stearic acid and docasanic acid. The preferred dimer acid-based tetraamide is the reaction product of dimer acid, ethylene diamine and stearic acid in a stoichiometric ratio of 1:2:2, respectively. Stearic acid is the preferred fatty acid reactant because its adduct with dimer acid and ethylene diamine has the lowest viscosity of the dimer acid-based tetra-amides.

The fatty amide-containing material can also comprise a mono-amide. In fact, in the preferred case, the phase change ink carrier composition comprises both a tetra-amide compound and a mono-amide compound. The mono-amide compound typically comprises either a primary or secondary mono-amide, but is preferably a secondary mono-amide. Of the primary mono-amides stearamide, such as Kemamide S, manufactured by Witco Chemical Company, can be employed. As for the secondary mono-amides behenyl behemamide and stearyl stearamide are extremely useful mono-amides.

Another way of describing the secondary mono-amide compound is by structural formula. More specifically a suitable secondary mono-amide compound is represented by the structural formula:

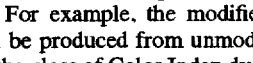

wherein:

x is an integer from 5 to 21;

y is an integer from 11 to 43;

a is an integer from 6 to 22; and b is an integer from 13 to 45.

The preferred fatty amide-containing materials comprise a plurality of fatty amide materials which are physically compatible with each other. Typically, even when a plurality of fatty amide-containing compounds are employed to produce the phase change ink carrier composition, the carrier composition has a substantially single melting point transition. The melting point of the phase change ink carrier composition is preferably at least about 70° C., more preferably at least 80° C. and most preferably at least 85° C.

The preferred phase change ink carrier composition comprises a tetra-amide and a mono-amide. The weight ratio of the tetra-amide to the mono-amide in the preferred instance is from about 2:1 to 1:10 and more preferably from about 1:1 to 1:3.

Modifiers can be added to the carrier composition to increase the flexibility and adhesion. A preferred modifier is a tackifier. Suitable tackifiers are compatible with fatty amide-containing materials and include, for example, Foral 85, a glycerol ester of hydrogenated abietic acid, and Foral 105, a pentaerythritol ester of hydroabietic acid, both manufactured by Hercules Chemical Company; Nevtac 100 and Nevtac 80. synthetic polyterpene resins manufactured by Neville Chemical Company, Wingtack 86, a modified synthetic polyterpene resin manufactured by Goodyear Chemical Company, and Arakawa KE 311, a rosin ester manufactured by Arakawa Chemical Company.

Plasticizers are optionally, and preferably, added to the phase change ink carrier to increase flexibility and lower melt viscosity. Particularly suitable plasticizers include dioctyl phthalate, diundecyl phthalate, alkylbenzyl phthalate (Santicizer 278) and triphenyl phosphate, all manufactured by Monsanto Chemical Company; tributoxyethyl phosphate (KP-140) manufactured by FMC Corporation; dicyclohexyl phthalate (Morflex 150) manufactured by Morflex Chemical Company Inc.; and trioctyl trimellitate, manufactured by Kodak.

Other materials may be added to the phase change ink carrier composition. In a typical phase change ink chemical composition, antioxidants are added for preventing discoloration of the carrier composition. The preferred antioxidant materials include Irganox 1010 manufactured by Ciba Geigy; and Naugard 76, Naugard 512, and Naugard 524 manufactured by Uniroyal Chemical Company; the most preferred antioxidant being Naugard 524.

A particularly suitable phase change ink carrier composition comprises a tetra-amide and a mono-amide compound, a tackifier, a plasticizer, and a viscosity modifying agent. The preferred compositional ranges of this phase change ink carrier composition are as follows: from about 10 to 50 weight percent of a tetraamide compound, from about 30 to 80 weight percent of a mono-amide compound, from about 0 to 25 weight percent of a tackifier, from about 0 to 25 weight percent of a plasticizer, and from about 0 to 10 weight percent of a viscosity modifying agent.

Preferred phase change inks exhibit a high level of lightness, chroma, and rectilinear light transmissivity when utilized in a thin film of substantially uniform thickness, so that color images can be conveyed using overhead projection techniques. Another preferred property of the ink carrier is the ability to be reoriented into a thin film after printing without cracking or transferring to the rollers typically used for reorientation.

A phase change ink printed substrate is typically produced in a drop-on-demand ink jet printer. The phase change ink is applied to at least one surface of the substrate in the form of a predetermined pattern of solidified drops. Upon impacting the substrate surface, the ink drops, which are essentially spherical in flight, wet the substrate, undergo a liquid-to-solid phase change, and adhere to the substrate. Each drop on the substrate surface is non-uniform in thickness and transmits light in a non-rectilinear path.

The pattern of solidified phase change ink drops can, however, be reoriented to produce a light-transmissive phase change ink film on the substrate which has a high degree of lightness and chroma, when measured with a transmission spectrophotometer, and which transmits light in a substantially rectilinear path. The reorientation step involves the controlled formation of a phase change ink layer of a substantially uniform thickness. After reorientation, the layer of light-transmissive ink will transmit light in a substantially rectilinear path. If the substrate on which the ink is applied is also light transmissive, a projected image having clearly visible intense colors can be formed when a beam of light is projected through the reoriented printed substrate.

Tape test density is a quantitative measurement indicating the propensity of the phase change ink to remain adhered to the media. The tape test is performed by adhering, using a 10 lb. roller weight, at least 10 cm of 3M Scotch Type 810 Magic Tape (19 mm wide) to cover all of a strip of a 5 cm×5 cm square, maximum black density (Tektronix 016-1307-00 black wax) single layer wax ink crosshatched pattern (with 5 mm spaced 0.2 mm lines without ink) printed on the media using a Tektronix Phaser 340 in the paper mode at 300×600 dpi, (monochrome) leaving approximately 1 cm of tape unattached. By grasping the unattached tape tag, the tape is pulled off of the media and printed area in one single rapid motion. The density of the peeled (Tp) and the original inked (To) areas on the media are measured using a Macbeth TR927 densitometer zeroed with the clear filter and using the "density" selection, taking care to center the Macbeth spot in a single 5 mm×5 mm crosshatched square. The tape test density is the loss of transmittance according to the following formula:

$$TT = \frac{(100 - \% Tp)}{(100 - \% To)} \times 100$$

where

TT is relative tape test density;

Tp is % transmittance of the area after the tape is peeled off; and

To is % transmittance of the original inked area.

A higher tape test density is preferred since this indicates a smaller percentage of phase change ink removal. No removal of phase change ink would be indicated by a tape test density of 100. Complete removal of the phase change ink would be indicated by a tape test density of 0. Tape test values are typically reproducible to a standard deviation of no larger than 5%.

To remove aging factors from consideration, the tape test densities reported herein are for fresh printings on four week old coatings.

The scratch resistance of coated media is measured by the use of the ANSI PH1.37-1977(R1989) method for determination of the dry scratch resistance of photographic film. The device used is described in the ANSI IT9.14-1992 method for wet scratch resistance. Brass weights up to 900 g. in the continuous loading mode are used to bear on a spherical sapphire stylus of 0.38 mm radius of curvature, allowing an estimated maximum loading of 300 kgm/cm$^2$. Since the stylus is a constant, the results can be reported in gram mass required to initiate and propagate a scratch, as viewed in reflected light. Scratch data is typically accurate to within approximately 50 gms. The reported scratch resistance is for samples measured four weeks after coating.

Total haze of the coated media is measured with a Gardner XL-211 Hazegard System calibrated to 1, 5, 10, 20 and 30 % haze NIST standards (standard deviation 0.02) on 35 mm wide strips held 1.2 cm from the transmission entrance on the flat surface of a quartz cell. The measured scattered light (TH) and the 100% scatter transmitted light reference (% REF) with the 100% diffuser in place are recorded. The result is reported as % TH=100×TH/% REF. The internal haze is measured similarly by immersing the strip into light mineral oil (Fisher 0121-1) in the quartz cell with the sample at the far face of the cell (closest to the position described above). The close index of refraction match of the mineral oil to the media allows assessment of the scattering arising from within the coating and polyester base. The difference between these two measures of haze is largely due to the roughness of the coated surface. The reported is for four week old coatings at ambient conditions.

The following examples illustrate the invention and are not intended to limit the scope of the invention.

EXAMPLES

Preparation of Coating Solutions

The binder polymer solutions were prepared in a jacketed, stirred container at about 7–8 wt %. The water soluble polymer, typically available as a powder, was dispersed at moderately high shear in deionized water for a short duration. The shear was decreased, the temperature was raised to above 90° C., and the conditions were maintained until the polymer was completely dissolved (approximately ½ hour). The solution was then cooled to 25°–30° C., and the weight percent solids measured. Water insoluble polymer dispersions were added to the solution to the desired weight percent. pH was adjusted to closely approximate that of the inorganic particulate material. Coating aids such as Triton X-100, ethyl alcohol, antimicrobials, bead dispersions and other additives can be added if desired. A solution containing the inorganic particulate matter was prepared in a separate, stirred container. The polymer solution and inorganic particulate matter solution were then combined and analyzed to insure that pH, viscosity and surface conductivity were suitable for coating. The mixtures were coated within 24 hours of their preparation.

Coating solutions were prepared as described above wherein the water soluble polymer was polyvinylacrylate available as Elvinol 90 from E. I. duPont de Nemours, of Wilmington, Del. The water insoluble polymer was Rhoplex WL-81 which is an acrylate available from Rohm & Haas, of Philadelphia, Pa. The inorganic particulate matter was silica with a hydrodynamic particle size of approximately 0.035 μm available as Snowtex-OUP from Nissan Chemical Industry, Ltd. of New York, N.Y.

The coating solution was coated using an air knife coating with variation of the solution analysis, coating speed, and air knife pressure to vary the coating thickness. The films were dried after coating using air impingement providing an air temperature of 90°–120° C. which provided a substrate temperature of 25°–29° C.

The results are recorded in the Table.

TABLE

| Sample | % Soluble | % Insoluble | % P | CW | TT | Haze | Scr |
|---|---|---|---|---|---|---|---|
| C-1 | 100 | — | 87 | 5 | 81 | 0.7 | 390 |
| C-2 | 100 | — | 86 | 6 | 78 | 1.0 | 345 |
| C-3 | 100 | — | 84 | 6.5 | 73 | 1.3 | 390 |
| C-4 | — | 100 | 78 | 5 | 88 | 3.3 | 320 |
| C-5 | — | 100 | 78 | 6 | 83 | 3.2 | 190 |
| C-6 | — | 100 | 78 | 3.5 | 85 | 2.5 | 280 |
| Inv-1 | 52 | 48 | 79 | 5 | 81 | 1.8 | 700 |
| Inv-2 | 52 | 48 | 79 | 6 | 69 | 1.5 | 800 |
| Inv-3 | 52 | 48 | 79 | 7 | 78 | 2.3 | 650 |

Where:

% Soluble is the percent of total weight of water soluble polymer and water insoluble polymer represented by the water soluble polymer.

% Insoluble is the percent of total weight of water soluble polymer and water insoluble polymer represented by the water insoluble polymer.

% P is the percent particulate matter as a function of the combined weight of the water soluble polymer water insoluble polymer and particulate matter.

CW is the coating weight of water soluble polymer, water insoluble polymer, and inorganic particulate matter in mg/dm2.

TT is the percent density remaining after the tape test. Haze is the total haze in % Total Haze. Scr. is weight required (grams) to initiate and propagate a scratch.

The inventive samples demonstrate increases in the weight required to initiate a scratch which indicates improved resistance to physical removal. Increased adhesion between the phase change ink and the inventive media is indicated by the increase in tape test density (TT).

What is claimed is:

1. A recording medium for phase change ink recording comprising:

a support;

1–30 mg/dm$^2$ of a receptive layer coated on said support wherein said receptive layer comprises:

a binder comprising:

a water soluble polymer; and a water insoluble polymer;

wherein the combined weight of said water soluble polymer and said water insoluble polymer comprises at least 15%, by weight, and no more than 90%, by weight, water insoluble polymer; and an inorganic particulate material with a diameter in water of no more than 0.3 μm wherein said inorganic particulate material represents at least 50%, by weight, and no more than 95%, by weight, of the combined coating weight of said water soluble polymer, said water insoluble polymer and said inorganic particulate material.

2. The recording medium for phase change ink recording of claim 1 wherein said water soluble polymer has a diameter in water of no more than 0.05 μm.

3. The recording medium for phase change ink recording of claim 2 wherein said water soluble polymer comprises at least one compound chosen from the group consisting of polyvinyl alcohol, polyacrylamide, methyl cellulose, polyvinyl pyrrolidone and gelatin.

4. The recording medium for phase change ink recording of claim 3 wherein said water soluble polymer is chosen from the group consisting of polyvinyl alcohol, polyvinyl pyrrolidone and gelatin.

5. The recording medium for phase change ink recording of claim 4 wherein said water soluble polymer is polyvinyl alcohol.

6. The recording medium for phase change ink recording of claim 2 wherein said water soluble polymer comprises polymerized monomer chosen from the group consisting of vinyl alcohol, acrylamide and vinyl pyrrolidone.

7. The recording medium for phase change ink recording of claim 1 wherein said water insoluble polymer has a diameter in water of at least 0.05 μm.

8. The recording medium for phase change ink recording of claim 7 wherein said water insoluble polymer comprises at least one compound chosen from the group consisting of acrylic, urethane, and polyolefin.

9. The recording medium for phase change ink recording of claim 8 wherein said water insoluble polymer is acrylic.

10. The recording medium for phase change ink recording of claim 7 wherein said water insoluble polymer comprises at least one polymerized monomer chosen from the group consisting of acrylic, olefin, vinyl, urethane and amide.

11. The recording medium for phase change ink recording of claim 1 wherein said diameter in water of said inorganic particulate material is no more than 0.1 μm.

12. The recording medium for phase change ink recording of claim 1 wherein said diameter in water of said inorganic particulate material is at least 0.005 μm.

13. The recording medium for phase change ink recording of claim 12 wherein said hydrodynamic diameter in water of said inorganic particulate material is at least 0.005 μm and no more than 0.03 μm and said inorganic particulate material has a surface area of 100 to 300 $m^2/g$.

14. The recording medium for phase change ink recording of claim 1 wherein said inorganic particulate material is a multispherically coupled colloidal silica comprising at least two spheres.

15. The recording medium for phase change ink recording of claim 14 wherein said multispherically coupled colloidal silica comprises at least seven spheres.

16. The recording medium for phase change ink recording of claim 1 comprising at least 3 $mg/dm^2$ of said receptive layer.

17. The recording medium for phase change ink recording of claim 1 comprising no more than 20 $mg/dm^2$ of said receptive layer.

18. The recording medium for phase change ink recording of claim 1 wherein said inorganic particulate material represents at least 70%, by weight, and no more than 90%, by weight, of the combined coating weight of said water soluble polymer, said water insoluble polymer and said inorganic particulate material.

19. The recording medium for phase change ink recording of claim 18 wherein said inorganic particulate material represents at least 75%, by weight, and no more than 90%, by weight, of the combined coating weight of said water soluble polymer, said water insoluble polymer and said inorganic particulate material.

20. A recording medium for phase change ink recording comprising:

a polyethylene terephthalate support;

1–30 $mg/dm^2$ of a receptive layer coated on said support wherein said receptive layer comprises:

a binder comprising:

a water soluble polymer with a diameter in water of no more than 0.05 μm; and a water insoluble polymer with a diameter in water of at least 0.05 μm;

wherein the combined weight of said water soluble polymer and said water insoluble polymer comprises at least 15%, by weight, and no more than 90%, by weight, water insoluble polymer; and an inorganic particulate material with a diameter in water of no more than 0.3 μm wherein said inorganic particulate material represents at least 75%, by weight, and no more than 90%, by weight, of the combined coating weight of said water soluble polymer, said water insoluble polymer and said inorganic particulate material.

* * * * *